US007021079B2

(12) United States Patent
Contrino

(10) Patent No.: US 7,021,079 B2
(45) Date of Patent: Apr. 4, 2006

(54) PORTABLE HOCKEY PUCK FREEZER

(76) Inventor: Tony Contrino, 11409, Pigeon, Montreal-Nord, Quebec (CA) H1G 5V8

( * ) Notice: Subject to any disclaimer, the term of this patent is extended or adjusted under 35 U.S.C. 154(b) by 0 days.

(21) Appl. No.: 10/927,438

(22) Filed: Aug. 27, 2004

(65) Prior Publication Data

US 2005/0050912 A1 Mar. 10, 2005

Related U.S. Application Data

(60) Provisional application No. 60/500,018, filed on Sep. 5, 2003.

(51) Int. Cl.
*F25D 3/08* (2006.01)

(52) U.S. Cl. ..... 62/457.2; 62/371

(58) Field of Classification Search .... 62/457.1–457.9, 62/371, 530
See application file for complete search history.

(56) References Cited

U.S. PATENT DOCUMENTS

| | | | | |
|---|---|---|---|---|
| 4,403,567 | A * | 9/1983 | daCosta et al. | 118/500 |
| 4,656,840 | A * | 4/1987 | Loofbourrow et al. | 62/530 |
| 5,035,122 | A * | 7/1991 | Oogjen | 62/457.2 |
| 5,689,970 | A * | 11/1997 | Chopas | 62/372 |
| 5,858,263 | A | 1/1999 | Geary | |
| 6,209,343 | B1 * | 4/2001 | Owen | 62/457.2 |
| 6,276,162 | B1 * | 8/2001 | Schemel | 62/457.2 |
| 6,401,484 | B1 * | 6/2002 | Gano, III | 62/457.5 |

* cited by examiner

*Primary Examiner*—Melvin Jones

(57) ABSTRACT

A portable hockey puck freezer consists of a freezable gel as is well known in the art of <<ice packs>> and is put in a freezer, along with pucks so that when taken out of the freezer, the pucks will stay frozen for several hours until they are needed for playing.

5 Claims, 4 Drawing Sheets

PORTABLE HOCKEY PUCK FREEZER

This application claims priority based on provisional application No. 60/500,018 filed Sep. 5, 2003.

BACKGROUND OF THE INVENTION

1. Field of the Invention

The invention relates generally to refrigeration but more particularly to a refrigeration unit for hockey pucks 2. Background of the Invention Freezing hockey pucks has been known in the art for years. Indeed a stiff frozen puck is faster, makes crisper passes and bounces less than a warm puck. That is why professional hockey teams always have an ample supply of pucks kept in a freezer right on the premises.

Unfortunately, amateur hockey players do not benefit from such luxury. Although the prior art shows freezers that actually freeze water in the shape of a puck, these makeshift pucks are made of ice, not rubber as are real pucks. There is no reference to a portable hockey puck freezer.

SUMMARY OF THE INVENTION

The present invention discloses a portable hockey puck freezer that is compact and self contained. It has room for several pucks stacked vertically in rows.

The portable hockey puck freezer consists of a freezable gel as is well known in the art of <<ice packs>> and is put in a freezer, along with pucks so that when taken out of the freezer, the pucks will stay frozen for several hours until they are needed for playing.

The use of air space as insulation in known in the art and used for portable coolers. The use of gel packs frozen in a freezer and then put inside of a cooler is also known. What is not known is combining features of a cooler with gel packs integrated within and with compartments configured and sized for receiving hockey pucks. Current technology makes use of special gel having the property of remaining in a cold state for extended periods of time. Of course, as technology evolves, other types of materials could be used to achieve even better results.

The foregoing and other objects, features, and advantages of this invention will become more readily apparent from the following detailed description of a preferred embodiment with reference to the accompanying drawings, wherein the preferred embodiment of the invention is shown and described, by way of examples. As will be realized, the invention is capable of other and different embodiments, and its several details are capable of modifications in various obvious respects, all without departing from the invention. Accordingly, the drawings and description are to be regarded as illustrative in nature, and not as restrictive. For example, the use of the terms gel or gel packs refers to current technology but it should not be used in a limiting fashion but rather as a word or expression to conveniently label a material exhibiting the desired properties.

BRIEF DESCRIPTION OF THE PREFERRED EMBODIMENT

Figure 1:
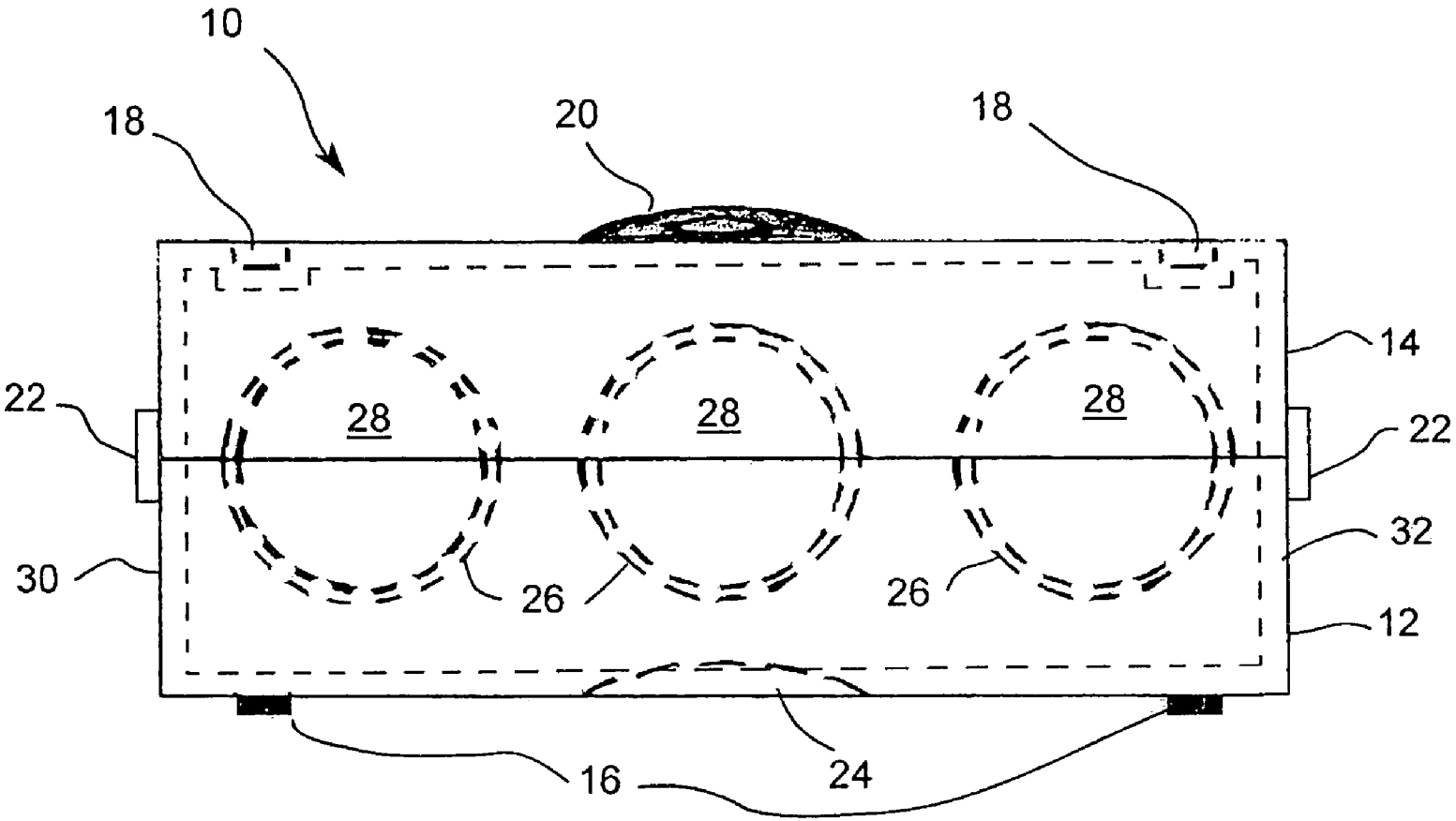

FIG. 1 See through side elevation of the portable puck freezer.

Figure 2:
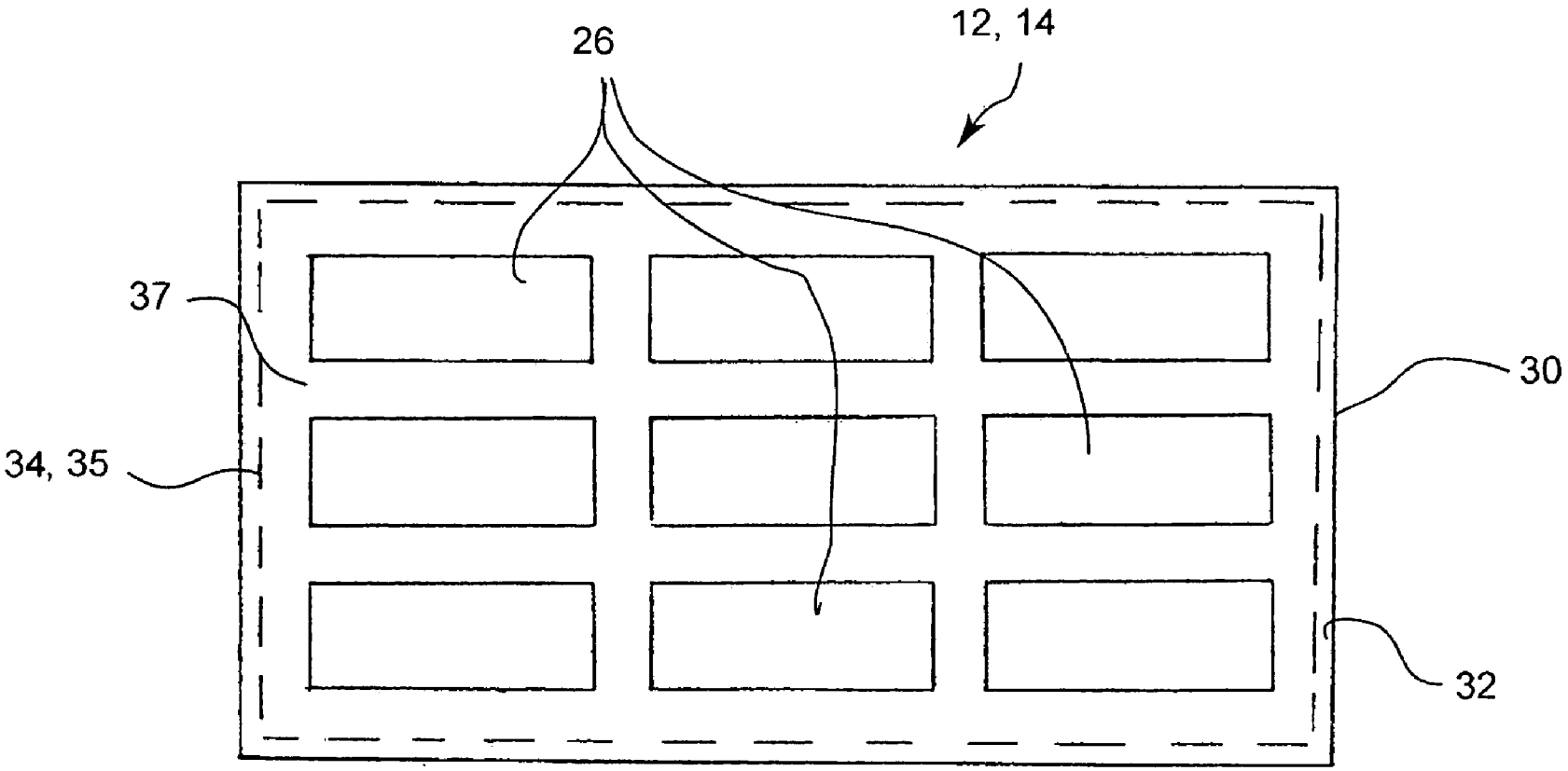

FIG. 2 Top view with lid open of the portable puck freezer.

Figure 3:
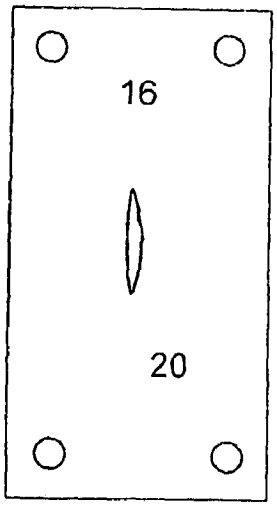

FIG. 3 Bottom view of the portable puck freezer.

Figure 4:
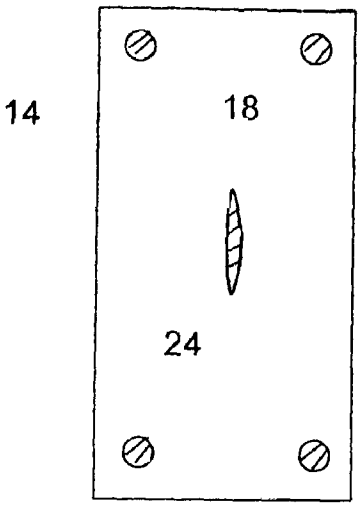

FIG. 4 Top view of the portable puck freezer.

Figure 5:
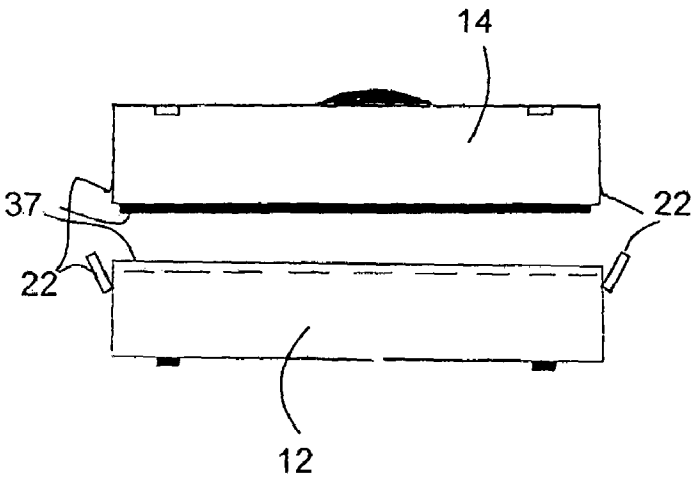

FIG. 5 Side elevation with lid separated from the base of the portable puck freezer.

Figures 6, 6A, 6B, 6C, 6D:
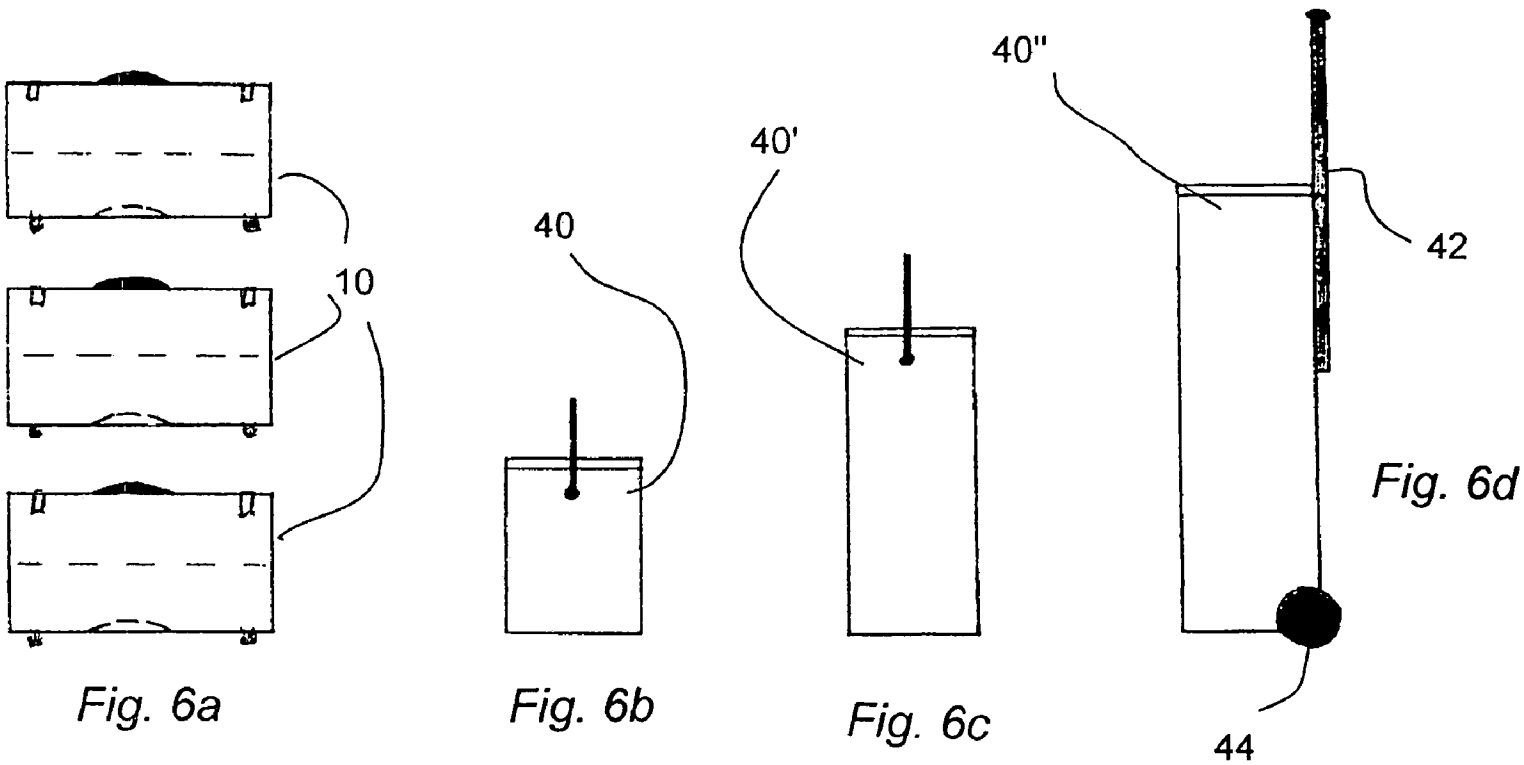

FIG. 6*a* Side view of stacked portable puck freezer.

FIG. 6*b* Custom insulated container for a single portable puck freezer.

FIG. 6*c* Custom insulated container for more than one portable puck freezer.

FIG. 6*d* Custom insulated container for more than one portable puck freezer with wheels and a telescopic handle.

DETAILED DESCRIPTION OF THE PREFERRED EMBODIMENT

A portable puck freezer (10) has a base (12) and a lid (14) that releasably attaches to the base. The base (12) has footings (16) extending therefrom which are positioned and sized so as to be received by corresponding recesses (18) situated on top of the lid (14) so as to make the portable puck freezer (10) stackable. A protruding carrying handle (20) is also situated on top of the lid (14) and extending therefrom. Retainer means (22) retain the lid (14) and the base (12) together. A handle recess (24) receives the handle (20) from another portable puck freezer (10) when stacked. Inside the portable puck freezer (10) are puck compartments (26) configured and sized to receive a puck (28).

The base (12) and the lid (14) are both built in a similar fashion and FIG. 2 shows what can, from this view, be both. An outer shell (30) provides the exterior finish and defines the outside periphery of an air space (32) which has its inner periphery defined by a gel containment wall (34). In FIG. 2 the dotted line which shows the location of the gel containment wall (34) also shows the location of a ridge (35). Depending on whether it is the the base (12) or the lid (14) we are looking at, an area inside of the ridge (37) can be higher for the base (12) or lower for the lid (14). The area inside the ridge (37) is the gel area (37) defined by the gel containment wall (34) on the outside and all remaining space as defined by the size of the base (12) and the lid (14) and not occupied by puck compartments (26) and the air space (32) and is filled with gel or any suitable substance designed to remain cold for extended periods of time. FIG. 1 shows a dotted line indicating that the air space (32) is not only located on the sides of the base (12) and lid (14) but also on the bottom of the base (12) and the top of the lid (14). The use of air space (32) in this fashion is well known in the art.

For practices, when several pucks are needed, several stacked portable puck freezer (10) can be fitted in a custom insulated container (40, 40', 40") such as illustrated in FIGS. 6*b,c,d*. These containers (40, 40', 40") provide additional insulation and have features such as telescopic handles (42), and wheels (44).

The invention claimed is:

1. A portable puck freezer for containing rubber based hockey puck comprising:

a base and a lid;

said lid being releasably attached to said base;

an outer shell to define the outside periphery of an air space and a gel containment wall to define the inner periphery of said air space;

said air space occupying sides top and bottom of said base and lid as defined by said outside periphery and inside periphery;

a gel area defined by said gel containment wall on the outside and all remaining space as defined by the size of said base and said lid and not occupied by puck compartments and said air space.

2. A portable puck freezer for containing rubber based hockey puck as in claim 1 wherein;

said base having footings extending therefrom, positioned and sized for receiving corresponding recesses situated on top of said lid so as to make said portable puck freezer stackable.

3. A portable puck freezer for containing rubber based hockey puck as in claim 1 wherein;

a protruding carrying handle situated on top of said lid and extending off said portable puck freezer;

a handle recess receiving said handle from another portable puck freezer when stacked.

4. A portable puck freezer for containing rubber based hockey puck as in claim 1 wherein:

retainer means retaining said lid and said base together.

5. A portable puck freezer for containing rubber based hockey puck comprising:

a base and a lid;

said lid being releasably attached to said base;

an outer shell to define the outside periphery of an air space and a gel containment wall to define the inner periphery of said air space;

said air space occupying sides top and bottom of said base and lid as defined by said outside periphery and inside periphery;

a gel area defined by said gel containment wall on the outside and all remaining space as defined by the size of said base and said lid and not occupied by puck compartments and said air space;

said base having footings extending therefrom, positioned and sized for receiving corresponding recesses situated on top of said lid so as to make said portable puck freezer stackable, a protruding carrying handle situated on top of said lid and extending off said portable puck freezer;

a handle recess receiving said handle from another portable puck freezer when stacked;

retainer means retaining said lid and said base together.

* * * * *